US008963676B1

(12) United States Patent
Hoang

(10) Patent No.: US 8,963,676 B1
(45) Date of Patent: Feb. 24, 2015

(54) CONFIGURABLE TRANSFORMER MODULE

(71) Applicant: XP Power Limited, Singapore (SG)

(72) Inventor: Kevin P. Hoang, City of Fountain Valley, CA (US)

(73) Assignee: XP Power Limited, Singapore (SG)

( * ) Notice: Subject to any disclaimer, the term of this patent is extended or adjusted under 35 U.S.C. 154(b) by 0 days.

(21) Appl. No.: 13/797,699

(22) Filed: Mar. 12, 2013

(51) Int. Cl.
*H01F 5/00* (2006.01)
*H01F 17/04* (2006.01)
*H01F 27/28* (2006.01)
*H01F 21/04* (2006.01)

(52) U.S. Cl.
CPC ..... *H01F 21/04* (2013.01)
USPC ..... 336/200; 336/221; 336/222; 336/232

(58) Field of Classification Search
CPC ..... H01F 2017/2819; H01F 2027/2809; H01F 17/0013; H02M 7/003; H05K 1/165; H05K 2201/086
USPC ..... 336/180, 182, 186, 200, 208, 221, 222, 336/232
See application file for complete search history.

(56) References Cited

U.S. PATENT DOCUMENTS 5,754,088 A * 5/1998 Fletcher et al. ..... 336/200
6,147,583 A * 11/2000 Rinne et al. ..... 336/200
6,638,531 B1 * 10/2003 Van Nieuw Amerongen et al. ..... 424/464
6,831,544 B2 * 12/2004 Patel et al. ..... 336/200
6,914,508 B2 * 7/2005 Ferencz et al. ..... 336/200
7,872,560 B2 * 1/2011 Hsu ..... 336/200

OTHER PUBLICATIONS

Author Unknown, "Design of Planar Power Transformers", Ferroxcube, Mar. 2012, pp. 1-15.
Lloyd Dixon, "Designing Planar Magnetics", Texas Instruments, Feb. 13, 2007, pp. 1-23, Topic 4.

* cited by examiner

*Primary Examiner* — Alexander Talpalatski
*Assistant Examiner* — Joselito Baisa
(74) *Attorney, Agent, or Firm* — Van Pelt, Yi & James LLP

(57) ABSTRACT

A configurable transformer module includes a primary printed circuit board, one or more secondary printed circuit boards, and one or more interface connectors. The primary PCB has planar primary windings formed thereon and openings for accommodating a planar transformer core. Each of the one or more secondary PCB has planar secondary windings and an opening for accommodating the planar transformer core. Some of the secondary PCB has mating terminals formed thereon. The planar secondary windings on a respective secondary printed circuit board are configured by electrical connections provided at a respective interface connector to realize a given transformer turns ratio between the respective secondary printed circuit board and the primary printed circuit board.

17 Claims, 11 Drawing Sheets

Secondary PCB 1

CONFIGURABLE TRANSFORMER MODULE

BACKGROUND OF THE INVENTION

The present invention relates to a transformer module, and more particularly, to a transformer module that is configurable to provide one or more transformer turns ratios.

A transformer is an electrical device that transfers energy by inductive coupling between two or more of its windings. A varying current in the primary winding creates a varying magnetic flux in the transformer's core and thus a varying magnetic flux through the secondary winding. This varying magnetic flux induces a varying voltage in the secondary winding.

In an ideal transformer, the induced voltage in the secondary winding (Vs) is in proportion to the primary voltage (Vp) and is given by the ratio of the number of turns in the secondary (Ns) to the number of turns in the primary (Np) as follows: Vs/Vp=Ns/Np. By appropriate selection of the ratio of turns, a transformer thus enables an alternating current (AC) voltage to be "stepped up" by making Ns greater than Np, or "stepped down" by making Ns less than Np. Typically, the windings are coils wound around a ferromagnetic core.

Transformers are used in many electrical circuits to realize power transfer while providing isolation. In one application, an isolation transformer is used in a resonant converter to generate an output DC voltage from an input DC voltage while providing isolation. Resonant converters are used in high voltage applications where high frequency operation and low switching losses are desired. Common resonant converter topologies include the LC series resonant converter and the LLC resonant converter which is a modified LC series resonant converter including a shunt inductor across the transformer primary winding. The LLC resonant converter has many advantages over the LC series resonant converter. For instance, the LLC resonant converter can regulate the output voltage over wide line and load variations which a relatively small variation of switching frequency. The LLC resonant converter can also achieve zero voltage switching over the entire operating range which improves efficiency.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process; an apparatus; a system; and/or a composition of matter. In this specification, these implementations, or any other form that the invention may take, may be referred to as techniques. In general, the order of the steps of disclosed processes may be altered within the scope of the invention.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

In embodiments of the present invention, a configurable transformer module includes a primary winding formed on one or more primary printed circuit boards (PCBs) and one or more secondary windings formed on respective secondary PCBs. The transformer turns ratio for each secondary winding is selected through configuration connectors coupled to interface connectors formed on either one of the primary PCBs or one of the secondary PCBs. Accordingly, each secondary winding can be readily configured to have the desired turns ratio through the use of connectors. In other words, the same secondary PCB can be configured for different turns ratio by using different connectors. In this manner, the transformer module can be advantageously applied in circuit applications to generate multiple output voltages, each with the same or different voltage values.

Figure 1:
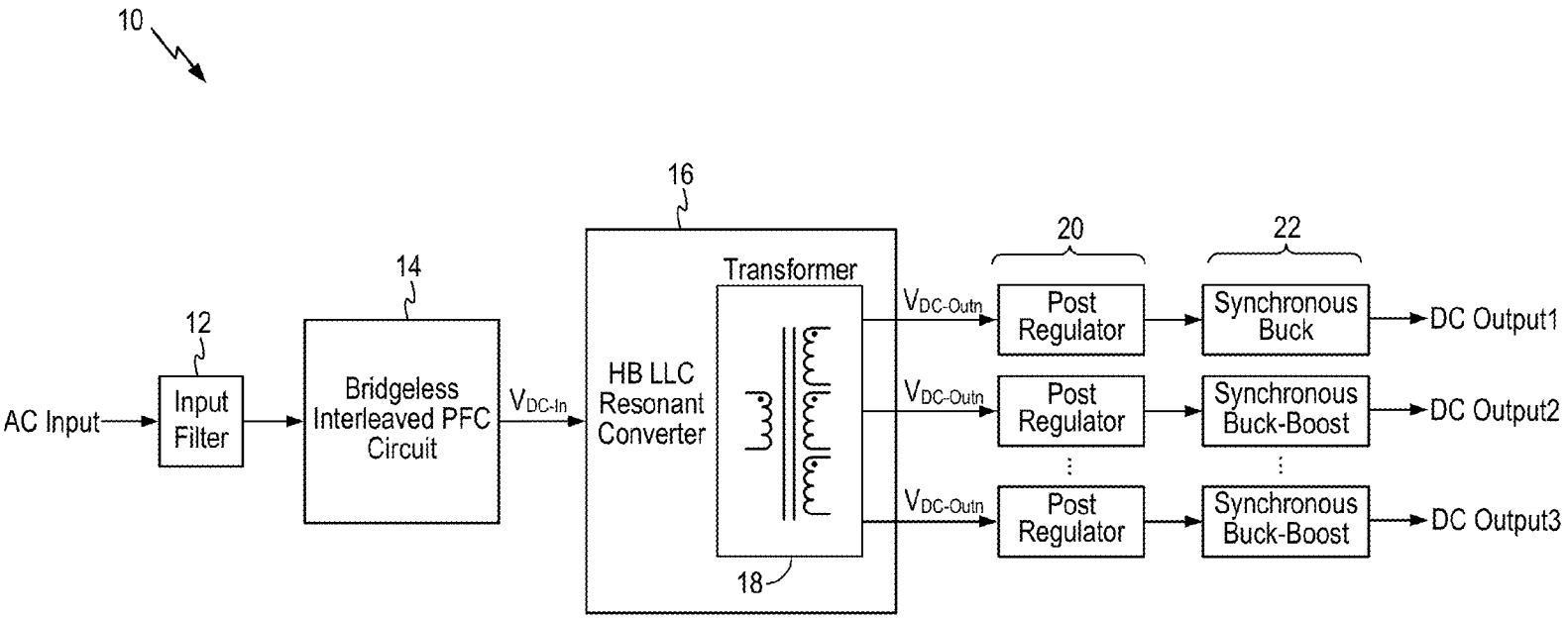
FIG. 1 is a schematic diagram illustrating an AC-to-DC power converter incorporating a half-bridge LLC resonant converter according in examples of the present invention.

In one embodiment, the configurable transformer module is incorporated in a half-bridge LLC resonant converter. The half-bridge LLC resonant converter may be incorporated in an AC-to-DC power converter to convert an input AC voltage to one or more regulated DC output voltages. FIG. 1 is a schematic diagram illustrating an AC-to-DC power converter incorporating a half-bridge LLC resonant converter according in examples of the present invention. Referring to FIG. 1, a power converter 10 receives an AC input voltage and generates one or more regulated DC output voltages at the same or different voltage levels. For example, the AC input voltage may be the AC line voltage (e.g. 120VAC) and the regulated output voltages may include 5V, 12V and 24V for powering various electronic devices.

The power converter 10 includes an input filter 12 for EMI (electromagnetic interference) filtering. The power converter 10 further includes an AC-to-DC converter 14 implemented as a bridgeless interleaved power factor correction (PFC) circuit to convert the AC input voltage to a DC voltage. In embodiments of the present invention, the PFC circuit 14 is implemented using a bridgeless interleaved boost topology. The DC converted voltage from the PFC circuit is then coupled to a half-bridge LLC resonant converter 16 which generates one or more DC output voltages having voltage levels regulated by the duty cycle or the switching frequency of the resonant converter. The half-bridge LLC resonant converter 16 includes an isolation transformer 18 operative to transfer power supplied to the LLC resonant converter to one or more DC output voltages while providing isolation for the subsequent circuitry. In embodiments of the present invention, the half-bridge LLC resonant converter 16 receives the DC input voltage $VD_{C-In}$ supplied from the PFC circuit 14 and generates one or more DC output voltages $V_{DC-Outn}$. In the present embodiment, transformer 18 includes a primary winding and multiple secondary windings to generate multiple DC output voltages $V_{DC-Outn}$. The multiple DC output voltages $V_{DC-Outn}$ may have the same or different voltage values.

Power converter 10 further includes a set of post regulators 20 receiving the output voltages from half-bridge LLC resonant converter 16 and generating respective DC output voltages. The DC output voltages generated by the post regulators 20 may not have the accuracy level desired. Power converter 10 further includes a set of synchronous buck or buck-boost converters 22 to receive the output voltages of the post regulators 20 and generate a set of regulated DC output voltages DC Output1 to DC Output3. The synchronous buck or buck-boost converters 22 generate regulated DC output voltages having the desired voltage value within the desired accuracy limits. In this manner, power converter 10 generates one or more regulated DC output voltages from the AC input voltage.

When a half-bridge LLC resonant converter is used to generate multiple output voltages, the isolation transformer includes one primary winding coupled to multiple secondary windings. In conventional implementations, the isolation transformer is formed so that the primary winding and each secondary winding have a fixed turns ratio. Thus, the LLC resonant converter provides a fixed set of output voltages. In order to allow the LLC resonant converter to be configurable for different output voltages, the LLC resonant converter has to include separate primary/secondary transformer modules for each desired output voltage value. The conventional implementation is not practical for large number of output voltages and also increases cost and size of the power converter.

According to embodiments of the present invention, a configurable transformer module implements selection of different transformer turns ratios through the use of configuration connectors. In this manner, the configurable transformer module can be readily configured to generate any desired set of output voltages by simply applying the corresponding connectors.

Figure 2:
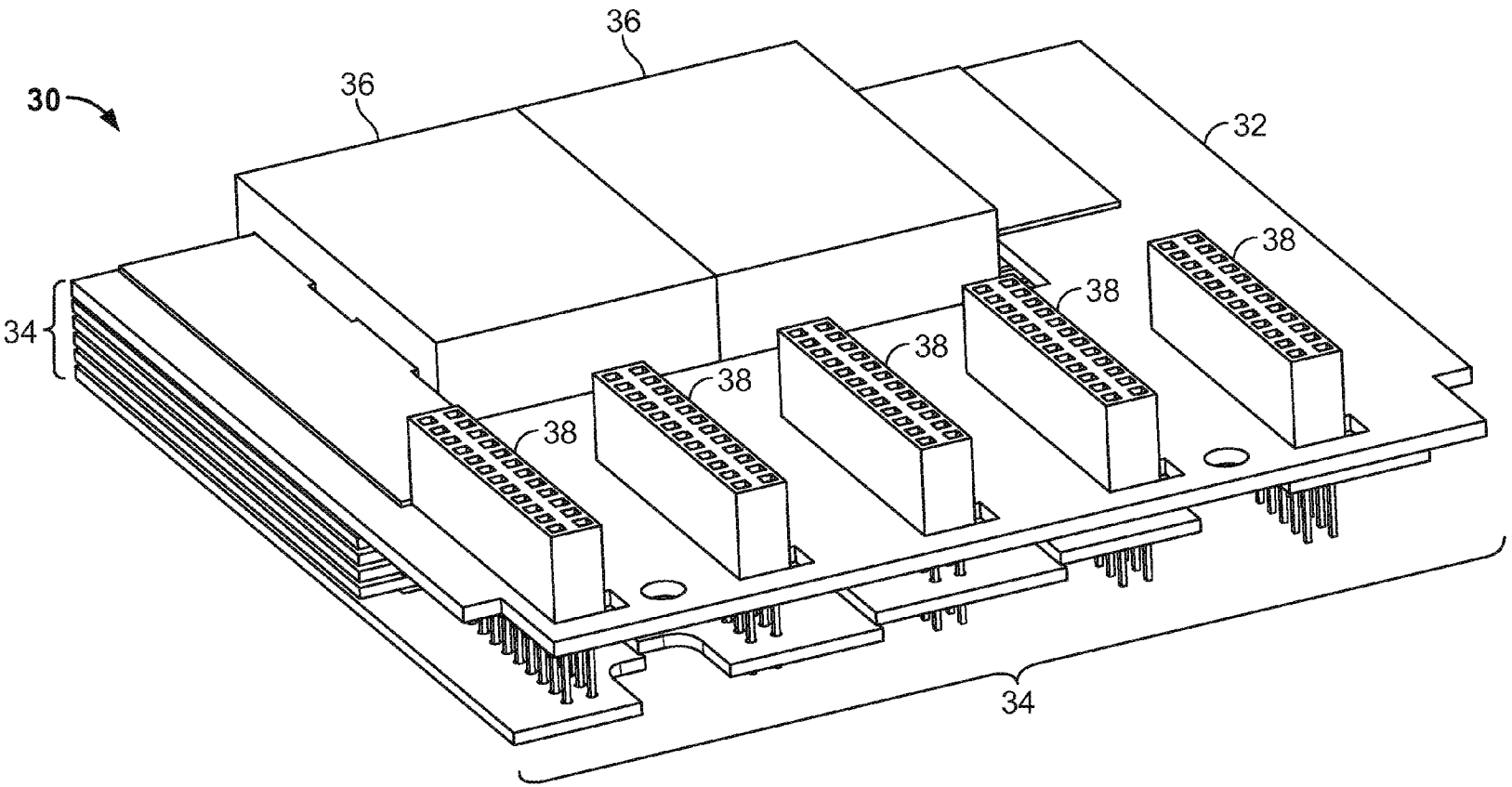
FIG. 2 is a perspective view of a configurable transformer module according to embodiments of the present invention.

FIG. 2 is a perspective view of a configurable transformer module according to embodiments of the present invention. Referring to FIG. 2, a configurable transformer module 30 is formed as a planar transformer where the primary and secondary windings are formed using metal traces on printed circuit boards (PCBs) with the windings formed on flat surfaces extending outward from the center-leg of a planar magnetic core. More specifically, the configurable transformer module 30 includes a primary PCB 32 having isolated primary windings formed thereon. The configurable transformer module 30 further includes one or more secondary PCB 34, each secondary PCB having isolated secondary windings formed thereon. In embodiments of the present invention, the primary and secondary PCBs are multilayer PCBs. The primary PCB 32 and the secondary PCBs 34 are stacked together so that the primary windings and the one or more secondary windings are vertically aligned with each other. A planar transformer core 36 is formed on and through openings in the primary PCB 32 and the one or more secondary PCBs 34 so that the primary and secondary windings wound around a center-leg of the transformer core 36. In one embodiment, the transformer core 36 is a ferromagnetic core.

In the present embodiment, one or more interface connectors 38 are formed on the primary PCB 32. The primary function of the interface connectors 38 are used to provide electrical connection to the secondary PCBs and to bring out the electrical connection on the primary PCB 32. In some embodiments, the interface connectors 38 also enable physical connection between the primary PCB and the secondary PCBs so that the PCBs are connected together physically to form a module. In the present embodiment, the primary PCB 32 includes terminal or vias formed thereon to receive the interface connectors 38. Each secondary PCB 34 includes mating terminals or vias that are to be electrically connected to a respective interface connector 38 on the primary PCB 32. In the present embodiment, the mating terminals formed on the secondary PCB 34 are vertically aligned with the terminals formed on the primary PCB for receiving a respective interface connector 38. In this case, the interface connectors 38 enable electrical connection and facilitate physical connection of the primary PCB 32 to the secondary PCBs 34. The vertical alignment is illustrative only and other configurations may be used.

Each interface connecter 38 is configured to accept a configuration connector (not shown) to configure or program the secondary windings on the associated secondary PCB 34 so that a desired turns ratio is realized between the primary winding and the secondary wining. In the present embodiment, the configuration connector is electrically connected to the mating terminals on the secondary PCB through the interface connector on the primary PCB. The configuration connector includes electrical connections to connect the planar secondary windings on the secondary PCB 34 either in parallel, or in series, or a combination of parallel and series connections. In this manner, the secondary windings on any given secondary PCB 34 can be configured to have the desired number of turns to achieve the desired transformer turns ratio with the primary windings so that each secondary PCB can be programmed to generate a desired output voltage. In other words, each secondary PCB can be configured by the configuration connector so that each secondary PCB generates the same or different output voltage as the other secondary PCBs. Accordingly, the configurable transformer module 30, as thus constructed, can be readily configured to provide multiple output voltages having the same or different output voltage values by using different configuration connectors.

In embodiments of the present invention, the interface connectors are formed using pin header type connectors connecting to terminals or vias formed on the primary PCB. The pin header type connector includes pins which are extended to connect to the mating terminals in a secondary PCB. The interface connectors can be male pin headers or female pin header connectors.

Figure 3:
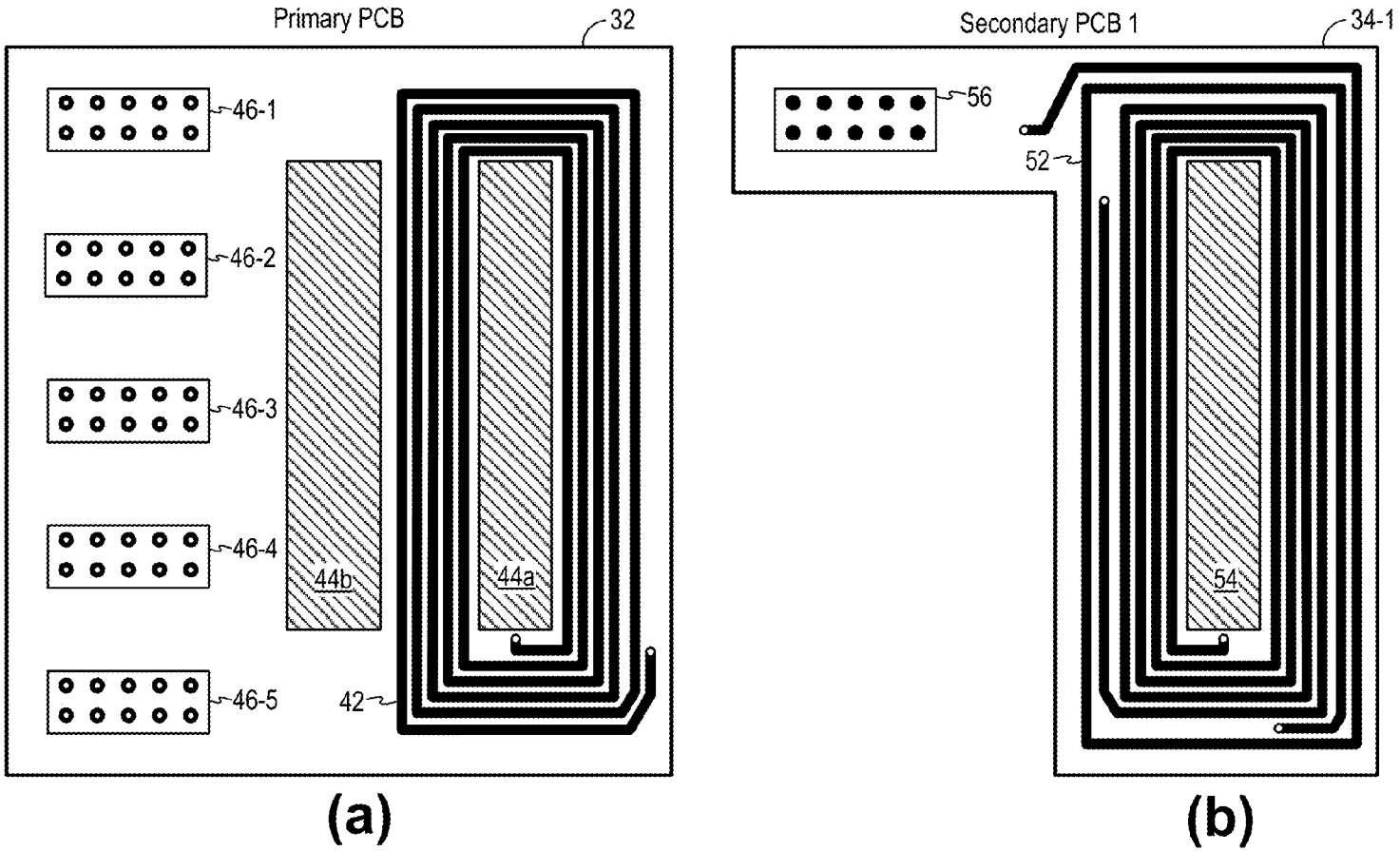
FIG. 3, which includes FIGS. 3(*a*) and 3(*b*), illustrates top views of a primary PCB and a secondary PCB of a configurable transformer module in embodiments of the present invention.

FIG. 3, which includes FIGS. 3(*a*) and 3(*b*), illustrates top views of a primary PCB and a secondary PCB of a configurable transformer module in embodiments of the present invention. Referring to FIG. 3, a primary PCB 32 (FIG. 3(*a*)) can be a single-layer or multilayer printed circuit board. The primary PCB 32 includes openings 44*a* and 44*b* for accepting the transformer core. Planar conductive windings 42 are formed on a single layer or on multiple layers of the printed circuit board. Planar conductive windings 42 are patterned to encircle the opening 44*a* disposed to accept the center-leg of the transformer core. Meanwhile, the opening 44*b* is disposed to accept an outer-leg of the transformer core. In the present embodiment, the primary PCB 32 further includes terminals 46 for receiving one or more interface connectors used to connect to the secondary PCBs. In the present embodiment, primary PCB 32 includes five sets of terminals 46-1 to 46-5 providing connecting to five interface connectors. The transformer module thus formed is capable of generating up to five output voltages having the same or different voltage values by connecting the appropriate configuration connectors to the interface connectors to be formed in the sets of terminals 46-1 to 46-5.

FIG. 3(*a*) provides a simplified view of the primary PCB 32 to illustrate the main elements of the primary PCB. The primary PCB 32 may include other conductive traces not shown to form various electrical connections, such as to connect the winding terminals of the primary and secondary windings or to connect the interface connectors to circuit elements such as resistors or capacitors.

FIG. 3(*b*) illustrates a secondary PCB 34-1 which can be coupled to the primary PCB 32 to form the configurable transformer module. Secondary PCB 34-1 can be a single-layer or multilayer printed circuit board. The secondary PCB 34-1 includes an opening 54 for accepting the center-leg of the transformer core. Planar conductive windings 52 are formed on a single layer or on multiple layers of the printed circuit board. Planar conductive windings 52 are patterned to encircle the opening 54 disposed to accept the center-leg of the transformer core. The secondary PCB 34-1 further includes mating terminals 56 for connecting to the interface connector 46 to be formed on the primary PCB 32. In particular, the secondary PCB 34-1 is configured so that the mating terminals 56 connect to the terminals 46-1 on the primary PCB 32. The planar conductive windings 52 formed on the secondary PCB 34-1 are configured by the configuration connector through the mating terminals to form either parallel windings, or series windings, or a combination of parallel and series windings. In this manner, a specific number of winding turns is realized on the secondary PCB to yield a desired turns ratio with the primary windings.

FIG. 3(*b*) provides a simplified view of the secondary PCB 34-1 to illustrate the main elements of the secondary PCB. The secondary PCB 34-1 may include other conductive traces not shown to form various electrical connections, such as electrical connections between the windings 52 and the mating terminals 56 to enable the windings 52 to be configured in parallel or in series or a combination of parallel and series connections.

Figure 4:
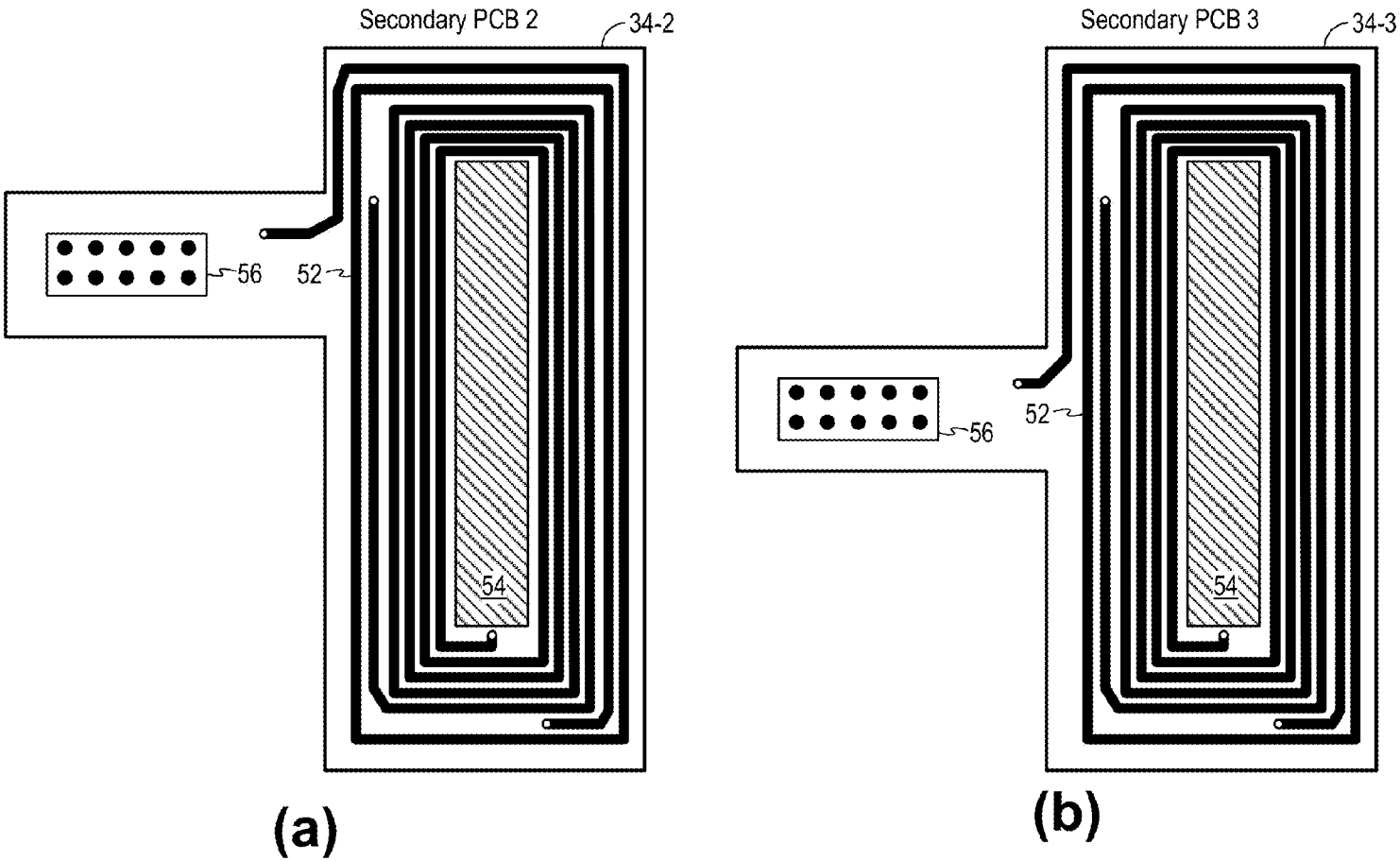
FIG. 4, which includes FIGS. 4(*a*) and 4(*b*), illustrates top views of secondary PCBs which can be coupled to the primary PCB of FIG. 3(*a*) to form a configurable transformer module providing multiple output voltages in embodiments of the present invention.

FIG. 4, which includes FIGS. 4(*a*) and 4(*b*), illustrates top views of secondary PCBs which can be coupled to the primary PCB of FIG. 3(*a*) to form a configurable transformer module providing multiple output voltages in embodiments of the present invention. In particular, FIG. 4 illustrates secondary PCBs 34-2 and 34-3 which are configured to couple to terminals 46-2 and 46-3, respectively, of the primary PCB 32. Secondary PCBs 34-2 and 34-3 are configured in a similar manner as secondary PCB 34-1 (FIG. 3(*b*)) and each can be configured by a configuration connector coupled to interface connectors to be formed in terminals 46-2 or 46-3 on the primary PCB 32 to connect the secondary windings in a desired manner to yield the desired turns ratio.

In one embodiment of the present invention, the windings on the secondary PCBs are connected in parallel to generate an output voltage of 5V, are connected in series and in parallel to generate an output voltage of 12V, and are connected in series to generate an output voltage of 24V. More specifically, the secondary windings are connected in parallel to realize a high current carrying capacity and are connected in series to obtain a high output voltage. Any combination of parallel and series connection can be used to obtain the desired output voltage at the desired output current level.

Figure 5:
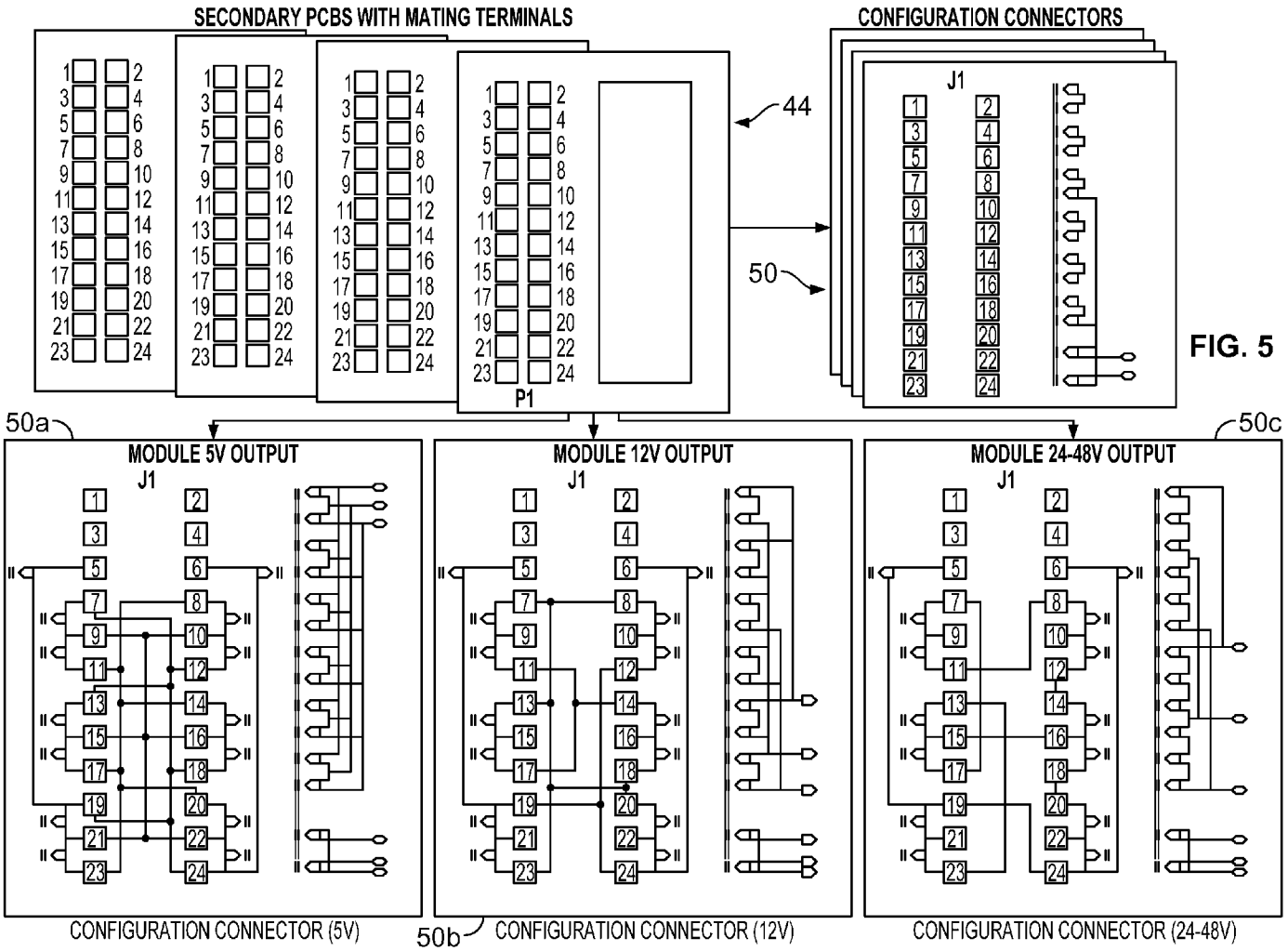
FIG. 5 illustrates configuration connectors which can be used to configure the secondary PCBs in embodiments of the present invention.

FIG. 5 illustrates configuration connectors which can be used to configure the secondary PCBs in embodiments of the present invention. Referring to FIG. 5, for a given set of secondary PCBs 44 provided with mating terminals, a set of configuration connectors 50 can be used to program each secondary PCBs 44 to have the desired number of winding turns. Specifically, each configuration connector 50 includes a set of programming terminals corresponding to the mating terminals on the secondary PCB 44. Electrical connections, such as wiring or metal traces, are used to interconnect the programming terminals of the configuration connector 50 to form the desired connection.

For example, a configuration connector 50*a* is shown including wiring to configure the secondary PCB to generate a 5V output. Another configuration connector 50*b* is shown including wiring to configure the secondary PCB to generate a 12V output. A third configuration connector 50*c* is shown including wiring to configure the secondary PCB to generate a 24-48V output. The configuration connectors 50 shown in FIG. 5 are illustrative only and not intended to be limiting. Other methods for forming the configuration connectors can be used.

Figure 6:
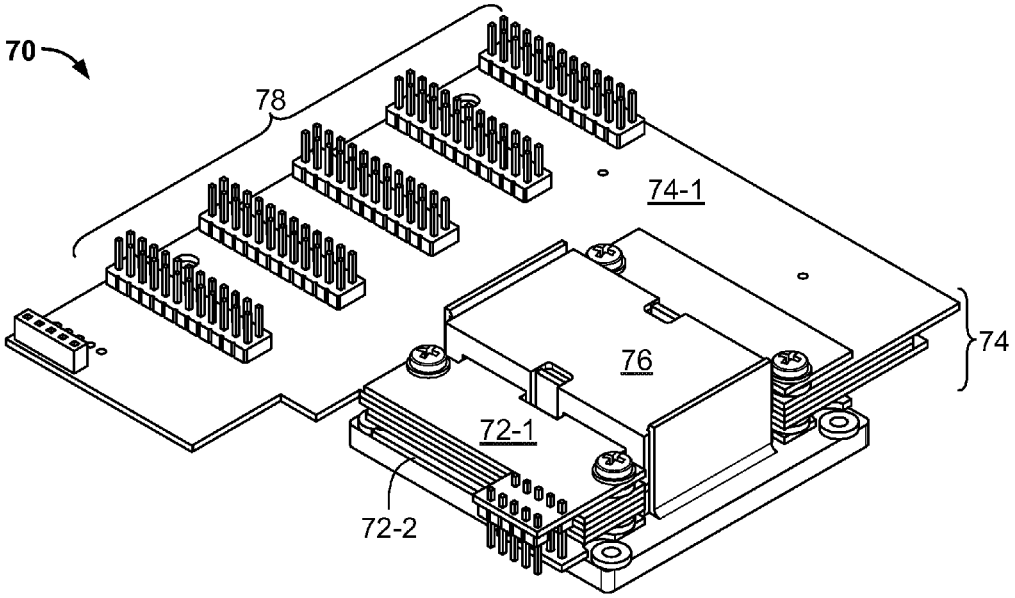
FIG. 6 is a perspective view of a configurable transformer module according to an alternate embodiment of the present invention.
Figure 7:
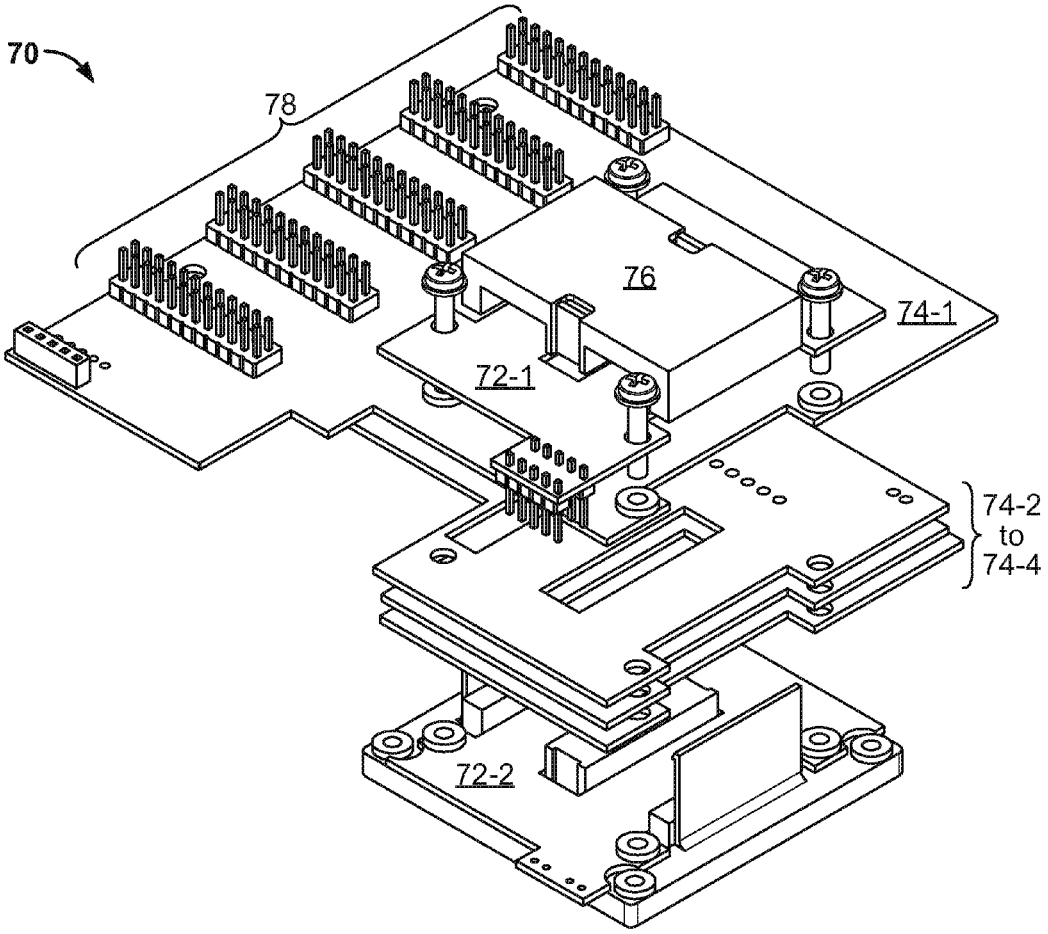
FIG. 7 is an exploded view of the configurable transformer module of FIG. 6.

In the above described embodiments, the interface connectors are formed on the primary PCB of the configurable transformer module. In alternate embodiments of the present invention, the interface connectors can be formed on one of the secondary PCBs. The primary PCB can then be formed to include only the primary windings. FIG. 6 is a perspective view of a configurable transformer module according to an alternate embodiment of the present invention. FIG. 7 is an exploded view of the configurable transformer module of FIG. 6.

Referring to FIGS. 6 and 7, a configurable transformer module 70 is formed as a planar transformer and includes a primary PCB1 (72-1) and a primary PCB2 (72-2) having primary windings form thereon. In the present embodiment, the primary windings are formed on two primary PCBs and are disposed on opposite ends of the PCB stack. In other embodiments, the primary windings can be formed on a single primary PCB. The primary PCBs 72-1 and 72-2 include openings for accepting the center-leg of a transformer core 76. In the present embodiment, the configurable transformer module 70 further includes a secondary PCB1 (74-1) on which interface connectors 78 are to be formed. The interface connectors provide electrical connection to the secondary PCBs. In some embodiment, the interface connectors also provide physical connection and support for binding together the secondary PCBs. The configurable transformer module 70 may include one or more additional secondary PCBs 74. In the case where the interface connectors 78 are formed on a secondary PCB, such as secondary PCB1, an interface connector is assigned to connect to the local secondary windings while the remaining connectors are assigned to connect to the secondary windings formed on the other secondary PCBs, as will be explained in more detail below.

Figure 8:
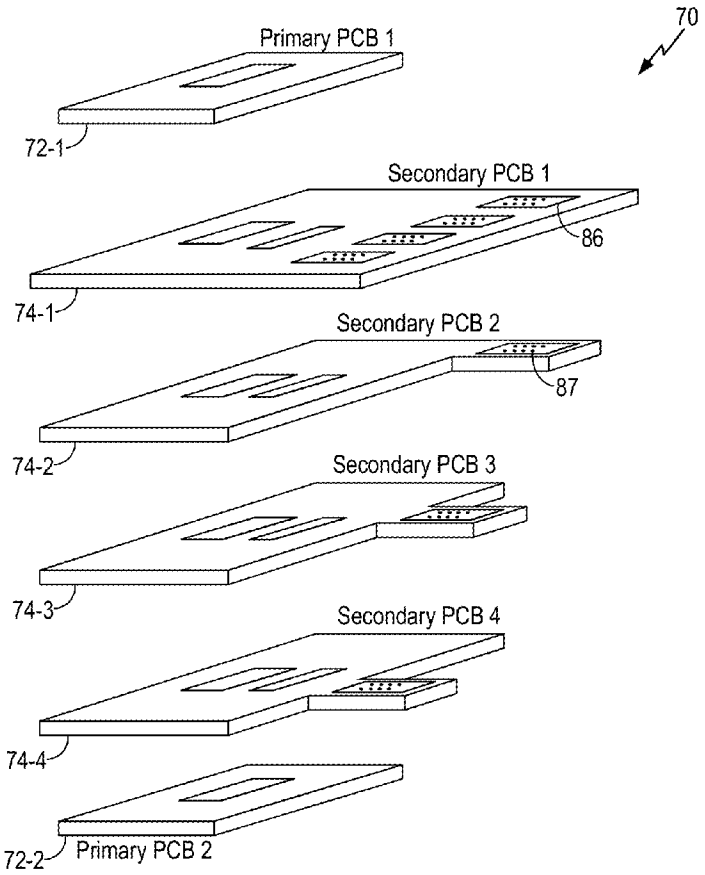
FIG. 8 is an exploded view of the winding PCBs in the configurable transformer module of FIG. 6.

FIG. 8 is an exploded view of the winding PCBs in the configurable transformer module of FIG. 6. Referring to FIG. 8, in the present embodiment, the PCB stack of the configurable transformer module 70 includes primary PCB1 (72-1) and primary PCB2 (72-2) arranged at the top and bottom of the PCB stack. In the present embodiment, the configurable transformer module 70 includes secondary PCB1 (74-1) on which the interface connectors are to be formed. In the present illustration, secondary PCB1 (74-1) includes four sets of terminals 86 for receiving four interface connectors (not shown). The interface connectors provide electrical connection to the secondary PCBs and may further provide physical support to the transformer module. The configurable transformer module 70 includes one or more additional secondary PCBs 74-2 to 74-4. Each secondary PCB 74 includes mating terminals 87 which are to be connected to a respective interface connector formed on the secondary PCB1 74-1. In the case where the interface connectors are formed on a secondary PCB, such as secondary PCB1, an interface connector is assigned to connect to the local secondary windings while the remaining connectors are assigned to connect to the secondary windings formed on the other secondary PCBs.

As thus configured, configuration connectors are provided and connect to the interface connectors formed on the secondary PCB1 to configure each secondary PCB to have a specific number of winding turns to yield a desired turns ratio with the primary windings.

FIG. 8 illustrates a particular arrangement for connecting the primary PCBs and the secondary PCBs. The PCB sequence shown in FIG. 8 is illustrative only and is not intended to be limiting. The configurable transformer module can be formed using primary PCBs and secondary PCBs that are arranged in other sequential order.

Figure 9A:
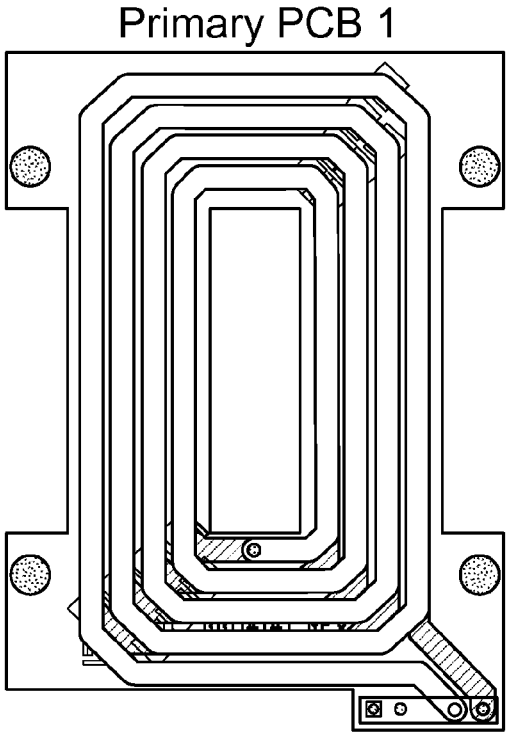
FIG. 9 is a top view of the primary PCBs which can be incorporated in the configurable transformer module of FIG. 6 in one example of the present invention.
Figure 9B:
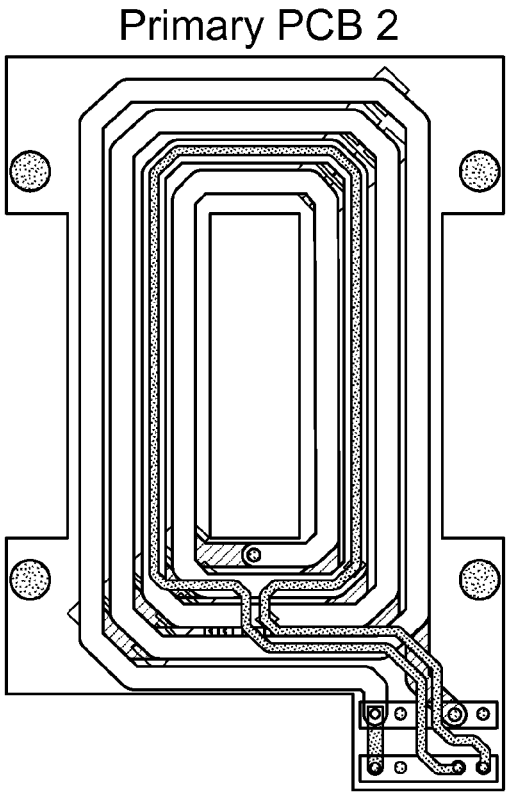
Figure 10:
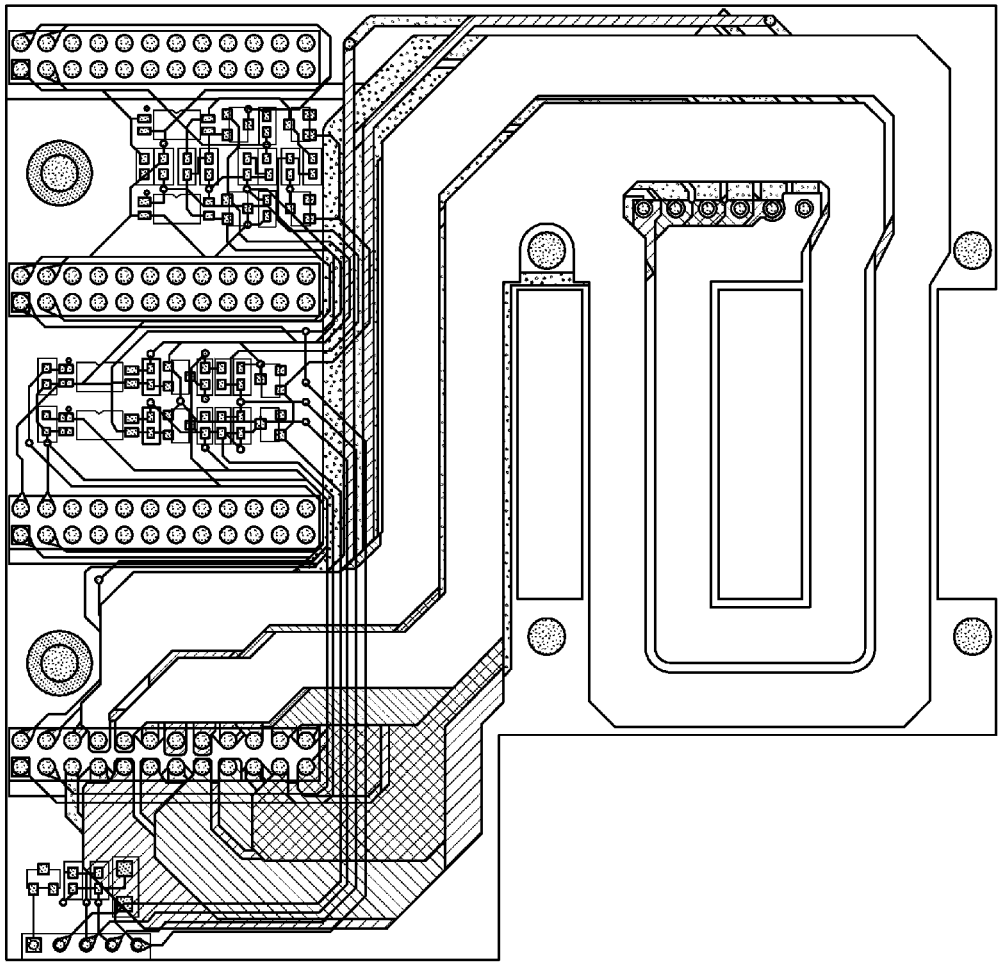
FIG. 10 is a top view of the secondary PCB1 which can be incorporated in the configurable transformer module of FIG. 6 in one example of the present invention.
Figure 11:
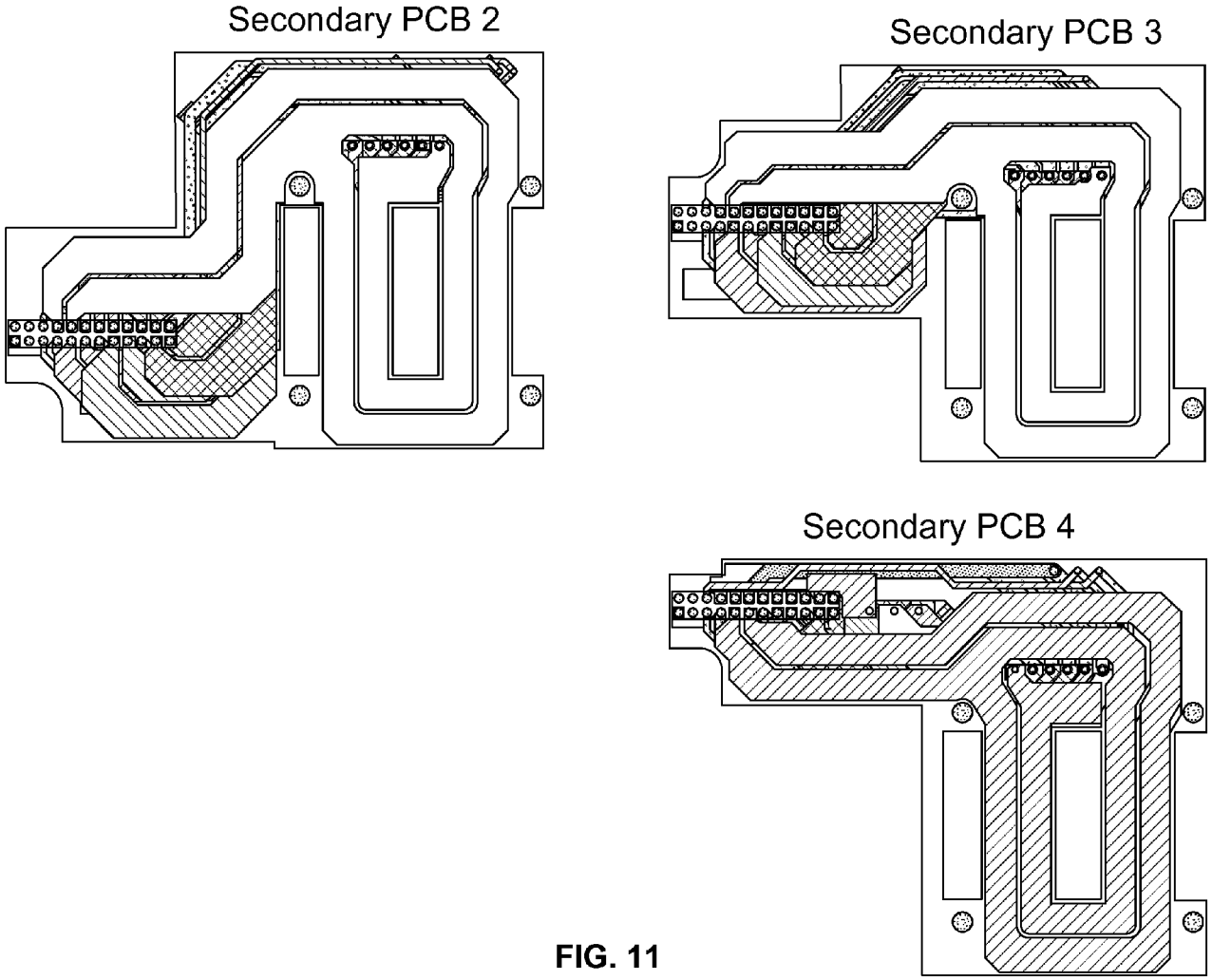
FIG. 11 is a top view of secondary PCB2 to PCB4 which can be incorporated in the configurable transformer module of FIG. 6 in one example of the present invention.

FIG. 9 is a top view of the primary PCBs which can be incorporated in the configurable transformer module of FIG. 6 in one example of the present invention. FIG. 10 is a top view of the secondary PCB1 which can be incorporated in the configurable transformer module of FIG. 6 in one example of the present invention. FIG. 11 is a top view of secondary PCB2 to PCB4 which can be incorporated in the configurable transformer module of FIG. 6 in one example of the present invention.

As described above, a configurable transformer module of the present invention can be configured to provide one or more output voltages simply by coupling the appropriate configuration connectors to the interface connectors. In one embodiment, the secondary transformer windings are floating when no configuration connectors are provided. In this manner, the same configurable transformer module can be used in various applications to deliver any desired set of output voltages simply by selecting the appropriate configuration connectors.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A configurable transformer module, comprising:

a primary printed circuit board having planar primary windings formed thereon, the primary printed circuit board including openings for accommodating a planar transformer core, the planar primary windings encircling a first opening accommodating a center-leg of the planar transformer core;

a first secondary printed circuit board, the first secondary printed circuit board having planar secondary windings formed thereon and including an opening for accommodating the center-leg of the planar transformer core where the planar secondary windings encircle the opening, the first secondary printed circuit board having mating terminals formed thereon;

a first interface connector formed on the primary printed circuit board to enable electrical connection to the first secondary printed circuit board and to facilitate physical connection of the primary printed circuit board to the first secondary printed circuit board to form the transformer module, the mating terminals formed on the first secondary printed circuit board being electrically connected to the first interface connector, the first interface connector being electrically insulated from the planar primary windings formed on the primary printed circuit board; and a first configuration connector module coupled to the first interface connector formed on the primary printed circuit board to configure the planar secondary windings on the first secondary printed circuit board to realize a given transformer turns ratio between the first secondary printed circuit board and the primary printed circuit board, the first configuration connector module comprising a plurality of programming terminals corresponding to the mating terminals formed on the first secondary printed circuit board, the programming terminals being interconnected to configure the planar secondary windings of the first secondary printed circuit board.

2. The configurable transformer module of claim 1, wherein the planar secondary windings on the first secondary printed circuit board are configured by the first configuration connector module coupled to the first interface connector to be connected in parallel, in series, or a combination of parallel and series connections.

3. The configurable transformer module of claim 2, wherein the first configuration connector module is disposed to electrically connect the planar secondary windings on the first secondary printed circuit board so that the windings are connected in parallel, in series, or a combination of parallel and series connections.

4. The configurable transformer module of claim 1, wherein the primary printed circuit board comprises a multilayer printed circuit board, the primary windings being formed on one or more layers of the multilayer printed circuit board.

5. The configurable transformer module of claim 1, wherein the first secondary printed circuit board comprises a multilayer printed circuit board, the secondary windings being formed on one or more layers of the multilayer printed circuit board.

6. The configurable transformer module of claim 1, further comprising a second secondary printed circuit board and a second interface connector formed on the primary printed circuit board and spaced apart from the first interface connector, the first secondary printed circuit board having mating terminals connected to the first interface connector formed on the primary printed circuit board and the second secondary printed circuit board having mating terminals connected to the second interface connector formed on the primary printed circuit board.

7. The configurable transformer module of claim 6, wherein the first configuration connector module is coupled to the first interface connector to configure the planar secondary windings on the first secondary printed circuit board to realize a first transformer turns ratio between the first secondary printed circuit board and the primary printed circuit board, and a second configuration connector module is coupled to the second interface connector to configure the planar secondary windings on the second secondary printed circuit board to realize a second transformer turns ratio between the second secondary printed circuit board and the primary printed circuit board.

8. The configurable transformer module of claim 7, wherein the first transformer turns ratio is different from the second transformer turns ratio.

9. The configurable transformer module of claim 7, wherein the first configuration connector module is disposed to electrically connect the planar secondary windings on the first secondary printed circuit board so that the windings are connected in parallel, in series, or a combination of parallel and series connections, and the second configuration connector module is disposed to electrically connect the planar secondary windings on the second secondary printed circuit board so that the windings are connected in parallel, in series, or a combination of parallel and series connections.

10. The configurable transformer module of claim 6, wherein the mating terminals of the first secondary printed circuit board are vertically aligned with the first interface connector formed on the primary printed circuit board and the mating terminals of the second secondary printed circuit board are vertically aligned with the second interface connector formed on the primary printed circuit board.

11. A configurable transformer module, comprising:

a primary printed circuit board having planar primary windings formed thereon, the primary printed circuit board including openings for accommodating a planar transformer core, the planar primary windings encircling a first opening accommodating a center-leg of the planar transformer core;

a first secondary printed circuit board having planar secondary windings formed thereon and including an opening for accommodating the center-leg of the planar transformer core where the planar secondary windings encircle the opening;

a second secondary printed circuit board having planar secondary windings formed thereon and including an opening for accommodating the center-leg of the planar transformer core where the planar secondary windings encircle the opening, the second secondary printed circuit board having mating terminals formed thereon;

a first interface connector and a second interface connector formed on the first secondary printed circuit board to enable electrical connection to the first and second secondary printed circuit boards and to facilitate physical connection of the first and second secondary printed circuit boards to form the transformer module, the planar secondary windings of the first secondary printed circuit board being electrically connected to the first interface connector, the mating terminals formed on the second secondary printed circuit board being electrically connected to the second interface connector;

a first configuration connector module coupled to the first interface connector formed on the first secondary printed circuit board to configure the planar secondary windings on the first secondary printed circuit board to realize a given transformer turns ratio between the first secondary printed circuit board and the primary printed circuit board; and a second configuration connector module coupled to the second interface connector formed on the first secondary printed circuit board to configure the planar secondary windings on the second secondary printed circuit board to realize a given transformer turns ratio between the second secondary printed circuit board and the primary printed circuit board, the second configuration connector module comprising a plurality of programming terminals corresponding to the mating terminals formed on the second secondary printed circuit board, the programming terminals being interconnected to configure the planar secondary windings of the second secondary printed circuit board.

12. The configurable transformer module of claim 11, wherein the first configuration connector module is disposed to electrically connect the planar secondary windings on the first secondary printed circuit board so that the windings are connected in parallel, in series, or a combination of parallel and series connections; and the second configuration connector module is disposed to electrically connect the planar secondary windings on the second secondary printed circuit board so that the windings are connected in parallel, in series, or a combination of parallel and series connections.

13. The configurable transformer module of claim 11, wherein the primary printed circuit board comprises a multilayer printed circuit board, the primary windings being formed on one or more layers of the multilayer printed circuit board.

14. The configurable transformer module of claim 11, wherein the first and second secondary printed circuit boards each comprises a multilayer printed circuit board, the secondary windings being formed on one or more layers of the multilayer printed circuit board.

15. The configurable transformer module of claim 11, wherein the first interface connector and the second interface connector are formed spaced apart on the first secondary printed circuit board, the second secondary printed circuit board having mating terminals that are vertically aligned with the second interface connector formed on the first secondary printed circuit board.

16. The configurable transformer module of claim 11, wherein the first configuration connector module is coupled to the first interface connector to realize a first transformer turns ratio between the first secondary printed circuit board and the primary printed circuit board and the second configuration connector module is coupled to the second interface connector to realize a second transformer turns ratio between the second secondary printed circuit board and the primary printed circuit board.

17. The configurable transformer module of claim 16, wherein the first transformer turns ratio is different from the second transformer turns ratio.

* * * * *